US007038431B2

(12) United States Patent
Benbrik

(10) Patent No.: US 7,038,431 B2
(45) Date of Patent: May 2, 2006

(54) ZERO TRACKING FOR LOW DROP OUTPUT REGULATORS

(76) Inventor: Jamel Benbrik, 387U Nautilus St., San Diego, CA (US) 92037

( * ) Notice: Subject to any disclaimer, the term of this patent is extended or adjusted under 35 U.S.C. 154(b) by 33 days.

(21) Appl. No.: 10/637,955

(22) Filed: Aug. 7, 2003

(65) Prior Publication Data

US 2005/0029995 A1 Feb. 10, 2005

(51) Int. Cl.
*G05F 1/56* (2006.01)

(52) U.S. Cl. ..... 323/273; 323/279; 323/280; 323/281

(58) Field of Classification Search ..... 323/273, 323/274, 280, 281, 279
See application file for complete search history.

(56) References Cited

U.S. PATENT DOCUMENTS 6,297,603 B1 * 10/2001 Carobolante ..... 318/254
6,420,857 B1 * 7/2002 Fukui ..... 323/280
6,717,474 B1 * 4/2004 Chen et al. ..... 330/301
6,791,390 B1 * 9/2004 Gay ..... 327/332

* cited by examiner

*Primary Examiner*—Gary L Laxton
(74) *Attorney, Agent, or Firm*—Philip Wadsworth; Charles O. Brown; Donald C. Kordich

(57) ABSTRACT

A low drop output regulator may be used for power management. The low drop out regulator may include an amplifier network having a transfer function may be used to provide a substantially constant voltage and variable current to a load. A zero compensation network may be used to add a zero to the transfer function that varies with the load current.

38 Claims, 4 Drawing Sheets

ZERO TRACKING FOR LOW DROP OUTPUT REGULATORS

BACKGROUND

1. Field

The present invention relates generally to electronics, and more specifically, to zero tracking for low drop output regulators.

2. Background

Power management circuits often employ low drop output (LDO) regulators. A LDO regulator is capable of supplying a programmable voltage to a complex system of circuits from a single source, such as a battery. In order to limit undershoot of the output during current load transitions, a large bypass capacitor is often placed at the output of the LDO regulator. This capacitor also tends to stabilize the LDO regulator by adding a dominant pole at the output. As long as the dominant pole is sufficiently far from the other poles to achieve a 45° phase margin, stability is maintained.

Many applications today, such as cellular telephones and the like, require high performance LDO regulators. At the same time, manufacturers and designers are continuously attempting to provide a more compact solution that is lower in cost, more reliable, and consumes less power. A smaller bypass capacitor which could be integrated into the LDO regulator would serve these objectives well. The problem faced by designers is that the frequency of the dominant pole is set by this capacitor. As the capacitor value is decreased, the frequency of the dominant pole is increased. As the dominant poles moves towards the frequency of the other poles in the LDO regulator, the phase margin is reduced. At some point, the LDO regulator no longer has a dominant pole at the output, and behaves as a second order system. As a result, it becomes increasingly more difficult to maintain the stability of the LDO regulator under all current load conditions. Accordingly, there is a need for an innovative approach to ensure the stability of the LDO regulator under any current load variations with smaller capacitor values than are currently employed today.

SUMMARY

In one aspect of the present invention, a regulator includes an amplifier network configured to provide a substantially constant voltage and variable current to a load, and a zero compensation network coupled to the amplifier network, the zero compensation network having a resistance that varies with the load current.

In another aspect of the present invention, a regulator includes an amplifier network configured to provide a substantially constant voltage and a variable current to a load, and a zero compensation network coupled to the amplifier network, the zero compensation having a zero that varies with the load current.

In yet another aspect of the present invention, a regulator includes an amplifier network having a transfer function that converts a reference voltage to a substantially constant voltage with a variable load current, and a zero compensation network configured to add a zero to the transfer function that varies with the load current.

In a further aspect of the present invention, a regulator includes means for generating a transfer function that converts a reference voltage to a substantially constant voltage and variable current for a load, and means for adding a zero of the transfer function that varies with the load current.

In yet a further aspect of the present invention, a method of regulation includes converting a reference voltage to a substantially constant voltage and variable current for a load using an amplifier network having a transfer function, and adding a zero to the transfer function that varies with the load current.

It is understood that other embodiments of the present invention will become readily apparent to those skilled in the art from the following detailed description, wherein it is shown and described various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION

The detailed description set forth below in connection with the appended drawings is intended as a description of various embodiments of the present invention and is not intended to represent the only embodiments in which the present invention may be practiced. Each embodiment described in this disclosure is provided merely as an example or illustration of the present invention, and should not necessarily be construed as preferred or advantageous over other embodiments. The detailed description includes specific details for the purpose of providing a thorough understanding of the present invention. However, it will be apparent to those skilled in the art that the present invention may be practiced without these specific details. In some instances, well-known structures and devices are shown in block diagram form in order to avoid obscuring the concepts of the present invention. Acronyms and other descriptive terminology may be used merely for convenience and clarity and are not intended to limit the scope of the invention. In addition, for the purposes of this disclosure, the term "coupled" means "connected to" and such connection can either be direct or, where appropriate in the context, can be indirect, e.g., through intervening or intermediary devices or other means.

Figure 1:
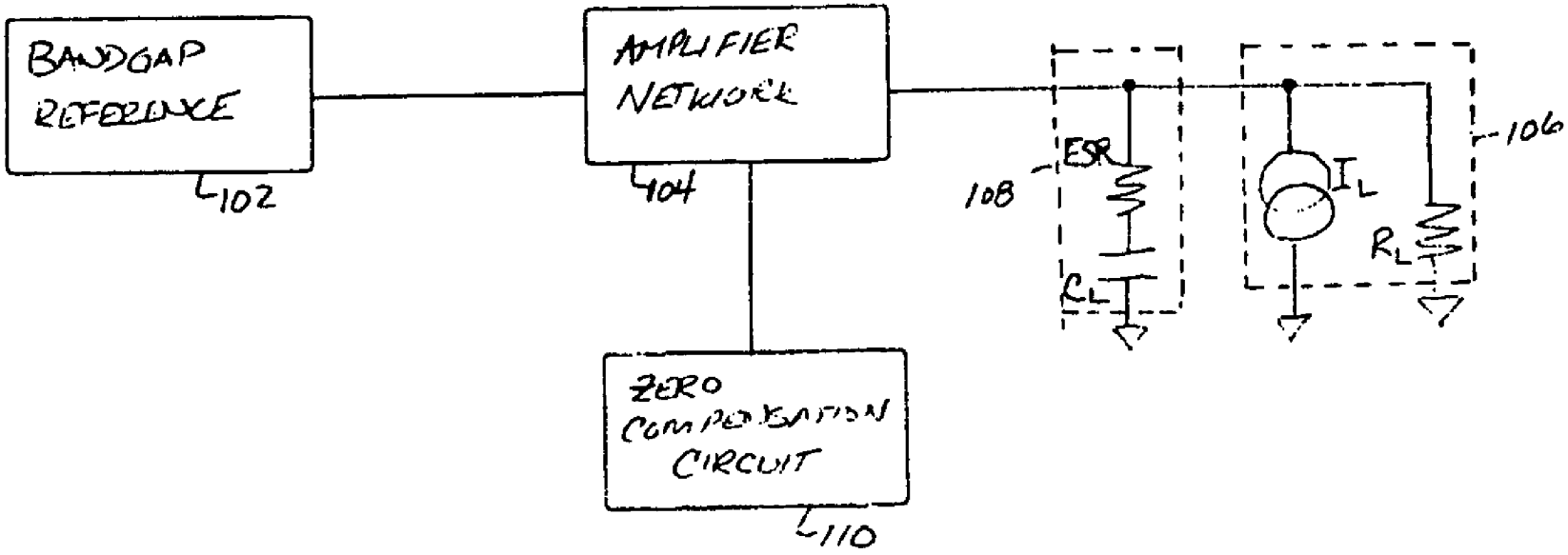
FIG. 1 is a conceptual block diagram illustrating an embodiment of a LDO regulator.

An example of an LDO regulator is shown in FIG. 1. The LDO regulator may employ a bandgap reference circuit 102, or other similar device, as a stable voltage source. An amplifier network 104 may be used to boost the voltage level of the bandgap reference circuit 102 and provide sufficient drive to a load 106. The load 106 may be modeled with an ideal current source $I_L$ and a load resistor $R_L$. The amplifier network 104 may be configured as a current amplifier which maintains a substantially constant output voltage across large variations in the load current $I_L$. A bypass capacitor 108 may be used at the output of the amplifier network 104 to help stabilize the LDO regulator. Alternatively, the bypass capacitor 108 may be integrated into the amplifier network 104. The bypass capacitor may be modeled with a series circuit having a load capacitor $C_L$ and an equivalent series resistance (ESR).

The stability of the LDO regulator may depend on the ratio of the maximum load current over the load capacitance ($I_{Lmax}/C_L$). The larger this ratio is, the more difficult it becomes to have a stable LDO regulator under all load conditions. Indeed, a very high $I_{Lmax}/C_L$ ratio means no dominant pole and a large dynamic variation of all poles versus the load current $I_L$. The advantage of having a high $I_{Lmax}/C_L$ ratio is that the gain bandwidth (GBW) of the LDO regulator is higher resulting in faster response time to current load variations. In addition, a smaller load capacitance may provide a more commercially viable product in terms of cost, reliability, power consumption and integration. A zero compensation circuit 110 may be used to stabilize a LDO regulator with a high $I_{Lmax}/C_L$ ratio. In a manner to be described in greater detail later, the zero compensation circuit 110 may be configured to add a zero to the transfer function of the amplifier network 104 that maintains a phase margin of 45° under all current load conditions. This may be achieved with zero compensation that tracks the GBW frequency.

Figure 2:
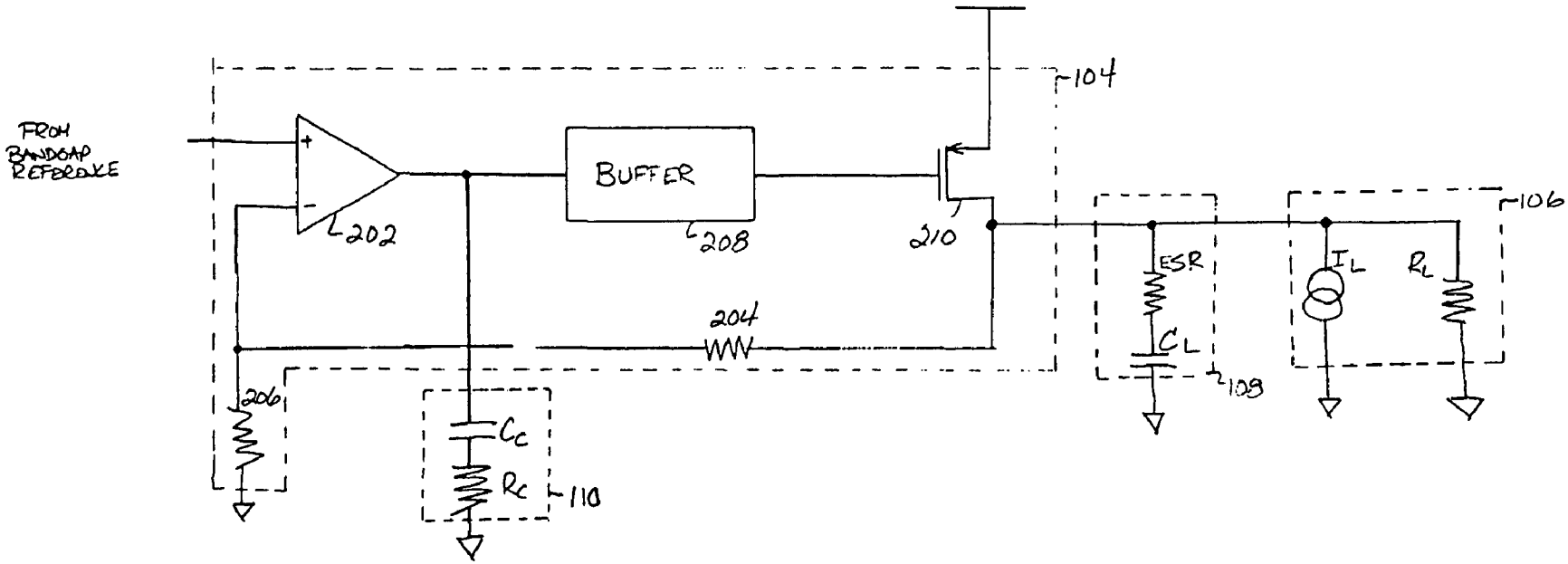
FIG. 2 is a conceptual block diagram illustrating an embodiment of an amplifier network with zero compensation in an LDO regulator.

FIG. 2 is a conceptual block diagram illustrating one possible implementation of the an amplifier network with zero compensation in an LDO regulator. In this implementation, the amplifier network 104 has three cascaded stages. The first stage may be one or more amplifier stages. A single stage transconductance amplifier 202 is shown in FIG. 2. The transconductance amplifier 202 may be configured as a non-inverting voltage-series feedback amplifier with resistors 204 and 206 being used to control the gain. The transconductance amplifier 202 provides good power supply rejection ratio (PSSR), which is largely dependent on the gain of the transconductance amplifier 202 at low frequencies. In addition, the transconductance amplifier 202 may improve the stability of the output voltage from the LDO regulator under varying load conditions. The second stage may be implemented with a buffer 208. The buffer 208 is generally a high impedance device which prevents loading down the amplifier 202. The buffer 208 may also act as a level shifter to apply the correct voltage to the final stage. The buffer 208 may be implemented with a series of transistors (not shown) forming a current mirror or any other suitable arrangement. The final stage may be implemented with a driver 210 which supplies the output current to the load 106. The driver 210 may be a field effect transistor (FET) or any other high current device.

The transfer function of the amplifier network 104 will have a pole $F_1$ at the output of the transconductance amplifier 202, a pole $F_2$ at the output of the buffer 208, and a pole $F_3$ at the output of the driver 210. The pole $F_3$ at the driver output can be expressed as follows:

$$F_3 = \frac{1}{2\pi R_L C_L} \tag{1}$$

As discussed in the background portion of this disclosure, a large load capacitor $C_L$ tends to stabilize the LDO regulator by adding a dominant pole at the output. A decrease in the load capacitor $C_L$ has the effect of sliding the pole $F_3$ at the output of the driver 210 to a higher frequency towards the pole $F_2$ of the transconductance amplifier 202. This causes the phase margin around the loop to decrease until the LDO regulator becomes unstable and breaks into oscillation. To maintain stable operation with a small load capacitor $C_L$, zero compensation may be added to the transfer function of the LDO regulator. The zero compensation may be added at the output of the transconductance amplifier 202 and modeled with a series circuit having a capacitor $C_C$ and a resistor $R_C$.

The stability of the LDO regulator will ultimately depend on the gain bandwidth (GBW). The GBW is the frequency $F_{0\ dB}$ at which the open loop response of the LDO regulator passes through unity. To ensure stable operation, the open loop response should pass through the GBW frequency $F_{0\ dB}$ at 20 dB/decade. To achieve this condition with a phase margin of 45°, the LDO regulator should be configured to satisfy the following equation:

$$\frac{1}{3}F_z \le F_{0\mathrm{dB}} \le 3F_2, \tag{2}$$

where $F_Z$ is the zero frequency and may be expressed as follows:

$$F_z = \frac{1}{2\pi R_c C_c}. \tag{3}$$

The capacitor $C_C$ and resistor $R_C$ values for the zero compensation circuit 110 may be determined by first evaluating the GBW frequency $F_{0\ dB}$. The GBW frequency $F_{0\ dB}$ may be expressed as follows:

$$F_{0\mathrm{dB}} = A_{LDO}\frac{F_1 F_3}{F_z}, \tag{4}$$

where $A_{LDO}$ is the open loop gain of the LDO regulator. The open loop gain $A_{LDO}$ of the LDO regulator may be expressed as:

$$A_{LDO}=g_{m1}A_{buffer}g_{m3}R_0R_L \tag{5},$$

where $g_{m1}$ is the transconductance of the amplifier 202, $A_{buffer}$ is the gain of the buffer 108, and $g_{m3}$ is the transconductance of the FET used in the driver 110. Referring back to equation (4), the frequency of the pole $F_1$ at the output of the transconductance amplifier 202 may be expressed as follows:

$$F_1 = \frac{1}{2\pi R_o C_c}, \tag{6}$$

where $R_O$ equals the output impedance of the transconductance amplifier 202. Substituting equations (1), (3), (5), and (6) into equation (4), equation (4) can be rewritten as:

$$F_{0dB} = \frac{g_{m1} A_{buffer} g_{m3} R_C}{2\pi C_L}. \quad (7)$$

From equation (7) one can readily see that the GBW frequency $F_{0\ dB}$ is proportional to the transconductance $g_{m3}$ of the FET used in the driver 110, which varies with the load current $I_L$. In other words, when the load current $I_L$ increases, so does the GBW frequency $F_{0\ dB}$. In order to satisfy the stability conditions set forth in equation (2), the zero compensation circuit 110 may be configured to vary in the same way. Since both the GBW frequency $F_{0\ dB}$ and the zero frequency $F_Z$ are dependent on $R_C$ (see equations (3) and (7)), the zero compensation circuit 110 can be configured to track the GBW frequency $F_{0\ dB}$ if $R_C$ is set to vary with the load current $I_L$. Substituting equations (3) and (7) into equation (2), and assuming the gain of the buffer $A_{buffer}$ is unity, the following expression may be obtained for $R_C$:

$$R_c^3 = \frac{3C_L}{C_C} \frac{1}{g_{m1}} \frac{1}{g_{m3}}, \quad (8)$$

where $g_{m3}$ may be expressed as:

$$\frac{1}{g_{m3}} = \frac{1}{2}\sqrt{\frac{K_3 L_3}{W_3 I_L}}, \quad (9)$$

where $L_3$ is the gate length of the FET in the driver 210, $W_3$ is the gate width of the FET, and $K_3$ is a constant which is technology specific to the FET. Substituting equation (9) into equation (8), equation (8) can be rewritten as:

$$R_c^2 = \frac{3}{2} \frac{C_L}{C_C} \frac{1}{gm_1} \sqrt{\frac{K_3 L_3}{W_3 I_L}}. \quad (10)$$

Equation (10) shows that the first stability condition of equation (2), $\frac{1}{3} F_Z \leqq F_{0\ dB}$, may be met if the zero compensation circuit 110 is configured with a variable resistance $R_C$ proportional to the $4^{th}$ root of the load current $I_L$.

Figure 3:
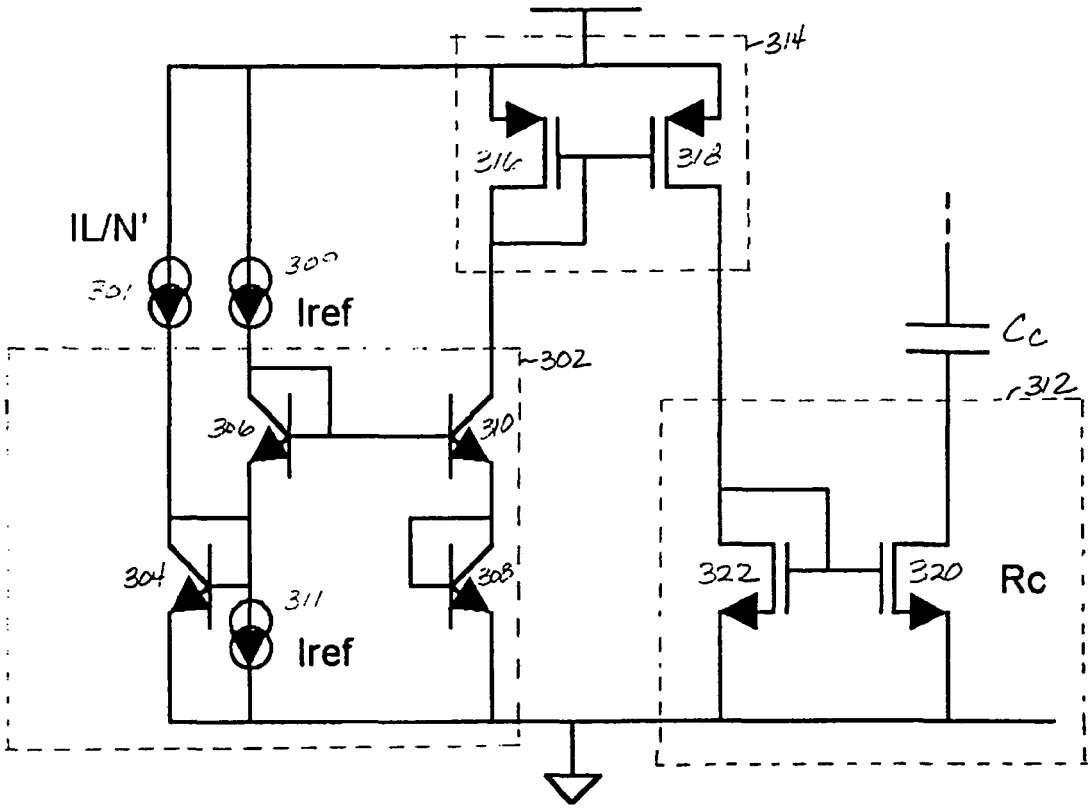
FIG. 3 is a schematic diagram illustrating an embodiment of a circuit for zero compensation.

FIG. 3 is a schematic representation of a circuit that may be used to implement the variable resistance $R_C$ of the zero compensation circuit of FIG. 2. Those skilled in the art will appreciate that many other circuit configurations are available for varying a resistance as a function of load current. Such circuit implementations are well within the capabilities of the skilled artisan. Referring to FIG. 3, the variable resistance may be implemented with a two stage circuit configuration. The first stage 302 may be used to generate a current which varies proportionally to the square root of the load current $I_L$. The square root function may be implemented through a bipolar configuration comprising transistors 304, 306, 308, and 310. Alternatively, an equivalent complimentary metal-oxide-semiconductor (CMOS) transistor arrangement may be used. A constant current source 301 may be used to introduce a current $I_L/N'$ that varies with the load current $I_L$ into the collector of the transistor 304 The constant current source 301 may be implemented as a current mirror configured to scale the load current and copy the scaled load current into the zero compensation circuit. Current sources 309 and 311 may be used to generate a reference current $I_{ref}$ to bias the transistor 306.

The current generated by the first stage 302 may be coupled to the second stage 312 using a current mirror 314 or other similar device. The current mirror may be implemented from the arrangement of a first P-channel metal-oxide-semiconductors (PMOS) transistor 316 arranged as a diode, and a second PMOS transistor 318 having a gate coupled to the gate of the first PMOS transistor.

The second stage 304 may be used to control the compensation current $I_C$ drawn from the transconductance amplifier 202. This may be achieved by varying the equivalent resistance of an N-channel metal-oxide-semiconductor (NMOS) field-effect transistor 320 operating in the triode region. This NMOS transistor will be referred to hereinafter as the "compensation transistor." In the triode region, the equivalent resistance of the compensation transistor 320 varies proportionally to the square root of the current introduced into a matched NMOS transistor 322 configured as a diode and having a gate coupled to the gate of the compensation transistor 320. The equivalent resistance $R_C$ of the compensation transistor 320 may be expressed as follows:

$$R_C = \frac{1}{K\frac{W_C}{L_C}(Vgs - Vt)} = \frac{L_C}{W_C}\sqrt{\frac{W_{ref}}{KL_{ref}}\frac{N'}{I_L}} = \frac{L_C}{W_C}\sqrt{\frac{W_{ref}}{KL_{ref}}}\sqrt[4]{\frac{N'}{I_L I_{ref}}}, \quad (11)$$

where: $L_C$ is the gate length of the compensation transistor 320;

$W_C$ is the gate width of the compensation transistor 320;

K is a constant which is technology specific to the compensation transistor 320;

$V_{gs}$ is the gate-to-source voltage of the compensation transistor 320;

$V_t$ is the threshold voltage of the compensation transistor 320;

$L_{ref}$ is the gate length of the transistor 318; and $W_{ref}$ is the gate width of the transistor 318.

From equation (11), one can readily see that the circuit implementation of FIG. 3 results in a resistance $R_C$ that varies with the $4^{th}$ root of the load current $I_L$.

Figure 4:
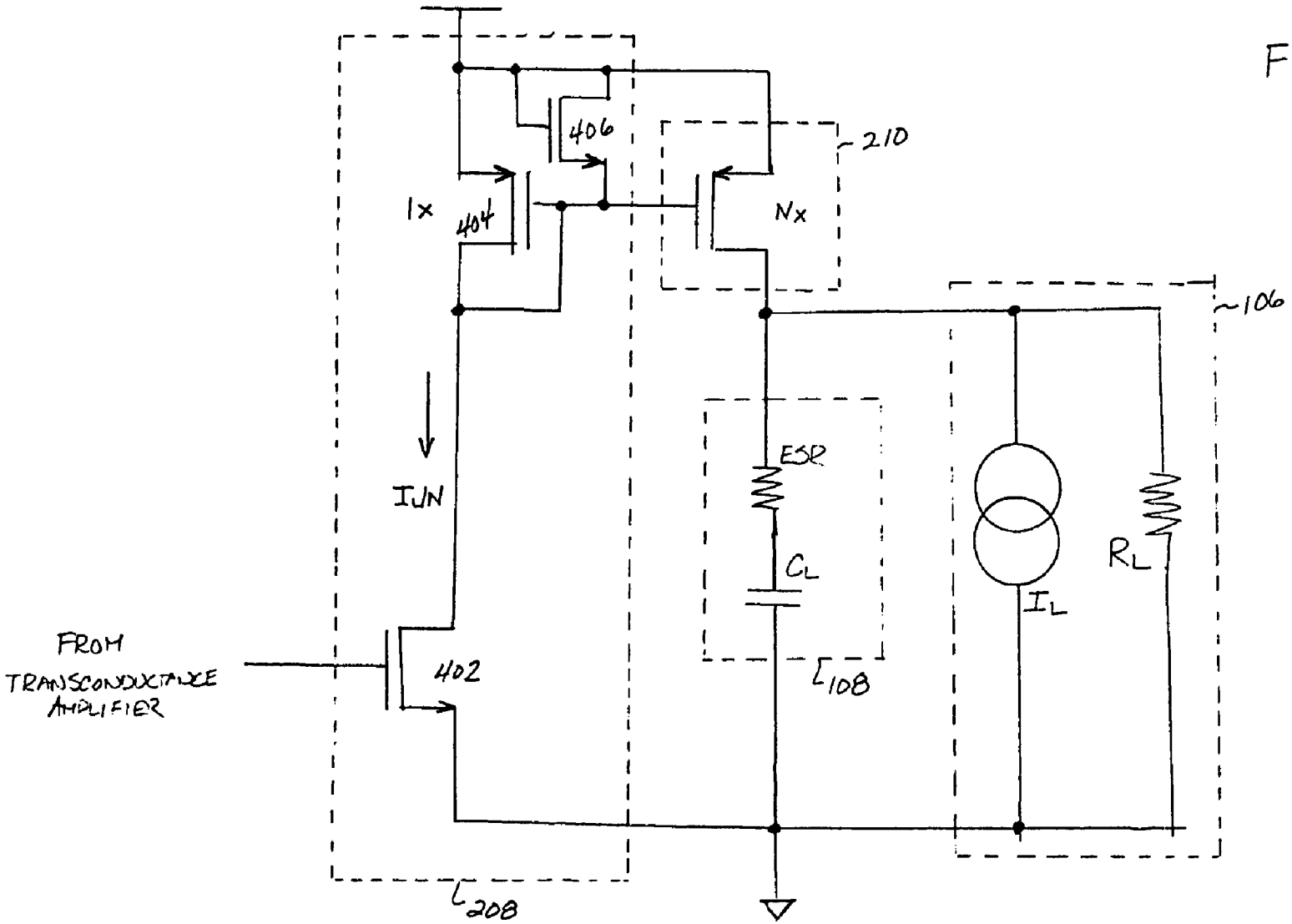
FIG. 4 is a schematic diagram illustrating a buffer circuit for use in the amplifier network of FIG. 2.

The second stability condition of equation (2), $F_{0\ dB} \geqq 3F_2$, may be satisfied with the buffer 208 design in FIG. 4. The buffer 208 may be designed with a pole $F_2$ that tracks the pole $F_3$ at the output of the driver 210. This may be achieved with a NMOS transistor 402 driven at its gate by the transconductance amplifier 202 output. A current mirror may be used in the drain circuit of the transistor 402. The current mirror may be constructed from a PMOS transistor 404 arranged as a diode and having a gain equal to 1/N the gain of the FET driver 210. An NMOS transistor 406 arranged as a diode may also be used to bias the gate of the FET driver 210 and the PMOS transistor 404. As a result of this circuit arrangement, the current through the transistor 402 is equal to the load current divided by N. The frequency of the pole $F_2$ at the output of the buffer 208 may be expressed as follows:

$$F_2 = \frac{g_{m2}}{2\pi C_3} = \sqrt{K\frac{L_3}{W_3}I_L}\,\frac{1}{\pi C_3}\frac{W_2}{L_2}, \tag{12}$$

where: $g_{m2}$ is the transconductance of the transistor NMOS transistor 406;

$C_3$ is the input capacitance of the FET driver 210

K is a constant which is technology specific;

$L_3$ is the gate length of the FET driver 210;

$W_3$ is the gate width of the FET driver 210;

$L_2$ is the gate length of the PMOS transistor 404; and $W_2$ is the gate width of the PMOS transistor 404.

From equation (12), one can readily see that the pole of the buffer $F_2$ varies proportionally to the square root of the load current $I_L$. In a logarithmic plot, it will increase two times faster than the pole at the output of the driver $F_3$. Therefore, if the pole at the output of the buffer $F_2$ is set high enough for low current loads, then the pole will always satisfy the second stability condition of equation (2).

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A regulator, comprising:

an amplifier network configured to provide a substantially constant voltage and variable current to a load; and a zero compensation circuit coupled to the amplifier network, the zero compensation circuit having a resistance that varies proportionally to the fourth root of the load current.

2. The regulator of claim 1 further comprising a capacitor coupled to an output of the amplifier network.

3. The regulator of claim 1 wherein the resistance of the zero compensation circuit comprises a compensation transistor.

4. The regulator of claim 3 wherein the amplifier network comprises a transconductance amplifier, and the zero compensation circuit further comprises a capacitor coupled between the transconductance amplifier and the compensation transistor.

5. The regulator of claim 4 wherein the resistance of the zero compensation circuit further comprises a current source configured to generate a first current which tracks the load current, a first root circuit configured to generate from the first current a second current which varies proportionally to the square root of the first current, and a second root circuit configured to generate from the second current a compensation current which varies proportionally to the square root of the second current, the second root circuit including the compensation transistor, the compensation transistor being configured to control the compensation current drawn from the transconductance amplifier through the capacitor.

6. The regulator of claim 5 wherein the resistance of the zero compensation circuit further comprises a current mirror configured to copy the second current from the first root circuit to the second root circuit.

7. The regulator of claim 5 wherein the second root circuit further comprises a diode configured to receive the second current, the compensation transistor being coupled to the diode.

8. The regulator of claim 7 wherein diode comprises a field effect transistor having a drain configured to receive the second current and a gate connected to the drain, and wherein the compensation transistor comprises a gate connected to the gate of the diode and a drain coupled through the capacitor to the transconductance amplifier.

9. The regulator of claim 4 wherein the amplifier network further comprises a driver configured to output the load current and a buffer coupled between the transconductance amplifier and the driver.

10. The regulator of claim 9 wherein the driver comprises a field effect transistor.

11. The regulator of claim 10 wherein the buffer comprises a current mirror.

12. A regulator, comprising:

an amplifier network configured to provide a substantially constant voltage and a variable current to a load; and a zero compensation circuit coupled to the amplifier network, the zero compensation having a zero that varies proportionally to the fourth root of the load current.

13. The regulator of claim 12 wherein the buffer comprises a current mirror.

14. The regulator of claim 12 further comprising a capacitor coupled to an output of the amplifier network.

15. The regulator of claim 12 wherein the zero compensation circuit comprises a variable resistance, the zero compensation circuit being configured to vary the zero by varying the resistance.

16. The regulator of claim 15 wherein the resistance of the zero compensation circuit comprises a compensation transistor.

17. The regulator of claim 16 wherein the amplifier network comprises a transconductance amplifier, and the zero compensation circuit further comprises a capacitor coupled between the transconductance amplifier and the compensation transistor.

18. The regulator of claim 17 wherein the resistance of the zero compensation circuit further comprises a current source configured to generate a first current which tracks the load current, a first root circuit configured to generate from the first current a second current which varies proportionally to the square root of the first current, and a second root circuit configured to generate from the second current a compensation current which varies proportionally to the square root of the second current, the second root circuit including the compensation transistor, the compensation transistor being configured to control the compensation current drawn from the transconductance amplifier through the capacitor.

19. The regulator of claim 18 wherein the second root circuit further comprises a diode configured to receive the second current, the compensation transistor being coupled to the diode.

20. The regulator of claim 19 wherein diode comprises a field effect transistor having a drain configured to receive the second current and a gate connected to the drain, and wherein the compensation transistor comprises a gate connected to the gate of the diode and a drain coupled through the capacitor to the transconductance amplifier.

21. The regulator of claim 18 wherein the resistance of the zero compensation circuit further comprises a current mirror configured to copy the second current from the first root circuit to the second root circuit.

22. The regulator of claim 17 wherein the amplifier network further comprises a driver configured to output the load current and a buffer coupled between the transconductance amplifier and the driver.

23. The regulator of claim 22 wherein the driver comprises a field effect transistor.

24. A regulator, comprising:

an amplifier network having a transfer function that converts a reference voltage to a substantially constant voltage with a variable load current; and a zero compensation circuit configured to add a zero to the transfer function that varies proportionally to the fourth root of the load current.

25. The regulator of claim 24 wherein the buffer comprises a current mirror.

26. The regulator of claim 24 further comprising a capacitor coupled to an output of the amplifier network.

27. The regulator of claim 24 wherein the zero compensation circuit comprises a variable resistance, the zero compensation circuit being configured to vary the zero by varying the resistance.

28. The regulator of claim 27 wherein the resistance of the zero compensation circuit comprises a compensation transistor.

29. The regulator of claim 28 wherein the amplifier network comprises a transconductance amplifier, and the zero compensation circuit further comprises a capacitor coupled between the transconductance amplifier and the compensation transistor.

30. The regulator of claim 29 wherein the amplifier network further comprises a driver configured to output the load current and a buffer coupled between the transconductance amplifier and the driver.

31. The regulator of claim 30 wherein the driver comprises a field effect transistor.

32. The regulator of claim 29 wherein the resistance of the zero compensation circuit further comprises a current source configured to generate a first current which tracks the load current, a first root circuit configured to generate from the first current a second current which varies proportionally to the square root of the first current, and a second root circuit configured to generate from the second current a compensation current which varies proportionally to the square root of the second current, the second root circuit including the compensation transistor, the compensation transistor being configured to control the compensation current drawn from the transconductance amplifier through the capacitor.

33. The regulator of claim 32 wherein the resistance of the zero compensation circuit further comprises a current mirror configured to copy the second current from the first root circuit to the second root circuit.

34. The regulator of claim 32 wherein the second root circuit further comprises a diode configured to receive the second current, the compensation transistor being coupled to the diode.

35. The regulator of claim 34 wherein diode comprises a field effect transistor having a drain configured to receive the second current and a gate connected to the drain, and wherein the compensation transistor comprises a gate connected to the gate of the diode and a drain coupled through the capacitor to the transconductance amplifier.

36. A regulator, comprising:

means for generating a transfer function that converts a reference voltage to a substantially constant voltage and variable current for a load; and means for adding a zero of the transfer function that varies proportionally to the fourth root of the load current.

37. A method of regulation, comprising:

converting a reference voltage to a substantially constant voltage and variable current for a load using an amplifier network having a transfer function; and adding a zero to the transfer function that varies proportionally to the fourth root of the load current.

38. The method of claim 37 wherein the zero is varied by varying a resistance coupled to the amplifier network.

* * * * *